United States Patent [19]

Uchida et al.

[11] Patent Number: 5,036,422

[45] Date of Patent: Jul. 30, 1991

[54] SOLENOID PUMP DRIVING CIRCUIT

[75] Inventors: Akito Uchida; Daiji Uehara, both of Ueda, Japan

[73] Assignee: Kabushiki Kaisha Nagano Keiki Seisakusho, Tokyo, Japan

[21] Appl. No.: 350,880

[22] Filed: May 12, 1989

[30] Foreign Application Priority Data

May 13, 1988 [JP] Japan ..... 63-62263[U]

[51] Int. Cl.[5] ..... H01H 47/00

[52] U.S. Cl. ..... 361/159; 361/189; 363/56

[58] Field of Search ..... 361/159, 160, 187, 199; 323/222; 363/56

[56] References Cited

U.S. PATENT DOCUMENTS

| | | | |
|---|---|---|---|
| 4,168,477 | 9/1979 | Burchall | 323/23 |
| 4,318,155 | 3/1982 | Thomas | 361/159 X |
| 4,392,172 | 7/1983 | Foley et al. | 361/159 X |
| 4,704,655 | 11/1987 | Yamauchi et al. | 361/159 |

*Primary Examiner*—A. D. Pellinen
*Assistant Examiner*—Jeffrey A. Gaffin
*Attorney, Agent, or Firm*—Sughrue, Miion, Zinn, Macpeak and Seas

[57] ABSTRACT

A driving circuit for driving a solenoid pump or the like, wherein a driving current supplied from a rechargeable battery 1 is alternately switched to on and off when flowing in an inductive element 2. The inductive element produces a driving force applied to the solenoid pump when the driving current flows therein. The inductive element generated a counter-electromotive force when the driving current flowing therein is interrupted. An accumulating circuit comprising a capacitor 5 is connected to the inductive element to accumulate the counter-electromotive force, and a releasing circuit 4 is connected to the accumulating circuit to release the counter-electromotive force accumulated in the accumulating circuit. The counter-electromotive force released from the releasing circuit produces a superfluous driving current and the latter current is superposed on the driving current supplied form the battery. The driving circuit thus configured reduces power consumption as well as eliminates the influence of the counter-electromotive force on the power source, thus preventing deterioration of the power source and elongating its service life. In addition, a single power source makes the driving circuit compact in size and light in weight.

6 Claims, 3 Drawing Sheets

SOLENOID PUMP DRIVING CIRCUIT

BACKGROUND OF THE INVENTION

The present invention relates to a driving circuit for a solenoid pump or the like, in which a driving current supplied from a rechargeable battery is alternately switched to on and off when flowing it in an inductive element for driving the solenoid pump, thereby generating a driving force.

Conventional solenoid pump driving circuits of the type to which the present invention relates will be described with reference to FIGS. 1 through 3.

According to the circuit shown in FIG. 1 which comprises an inductive element 10, a switching element 11 and a battery 12, when the switching element 11 is on-off controlled, a counter-electromotive force is generated in the inductive element 10. Therefore, the switching element 11 must withstand a voltage as great as the source voltage plus the induced reverse voltage.

The Japanese Utility Model Laid-Open Publication No. 62-15743 discloses a driving circuit as shown in FIG. 2 in which the circuit is designed to comply with the above requirement. In this circuit, a first rechargeable battery 36 serving to supply a source voltage as well as to clamp a voltage induced by a counter-electromotive force, has positive terminal coupled to the fixed contact of a first changeover switch 35. The first changeover switch 35 also has two movable contacts A1 and B1. The first battery 36 is coupled through the contact B1 to one terminal of an inductive element 30 serving as a plunger driver. Another terminal of the inductive element 30 is coupled to the negative terminal of the first battery 36 through a switching element 32. A second rechargeable battery 34 also serving to supply a source voltage and clamp a voltage induced by a counter-electromotive force, has a negative terminal coupled to the negative terminal of the first battery 36 and a positive terminal coupled to the fixed contact of a second changeover switch 33. The second changeover switch 33 also has movable contacts A2 and B2. The contacts A1 and B2 are coupled to each other. A reverse-current blocking diode 37 is interposed between a first node connecting the inductive element 30 and the switching element 32 and second node connecting the contacts A1 and B2, in which the anode of the diode 37 is connected to the first node and the cathode thereof to the second node. The changeover switches 33 and 35 are ganged together so as to be simultaneously changed over. Specifically, those switches 33 and 35 are changed respectively over to contacts A2 and A1 or to contacts B2 and B1.

If, in the above circuit, the switching element 32 is closed, and at the same time, the changeover switches 33 and 35 are changed over to their respective contacts B2 and B1, a current flows in a loop defined by the first battery 36, changeover switch 35, inductive element 30 and changeover switch 32, to thus drive a plunger.

When the switching element 32 is then opened, a current is generated due to the counter-electromotive force of the inductive element 30. And, this current flows through a loop defined by the inductive element 30, diode 37, contact B2, changeover switch 33, rechargeable batteries 34 and 36, and changeover switch 35 in the stated order, wherein a current is regenerated from the battery 34.

When the switching element 32 is closed at the same time when the changeover switches 33 and 35 are thrown to their respective terminals A2 and A1, a current flows through a loop defined by the second battery 34, changeover switch 33, contact A2, inductive element 30 end switching element 32 in the stated order. As a result, the plunger is again driven.

When the switching element 32 is subsequently opened, a current induced again due to the counter-electromotive force of the inductive element 30 flows through a loop defined by the inductive element 30, the diode 37, contact A1, batteries 36 and 34, changeover switch 33 and contact A2, wherein a current is regenerated from the first battery 36. This arrangement increases the durations of the rechargeable batteries 34 and 36.

Japanese Patent Application Laid-Open Publication No. 59-65581 discloses another driving circuit as shown in FIG. 3 which is also designed to comply with the aforementioned requirement regarding the withstand voltage. In this circuit, a rechargeable battery 20 is coupled to both a first series circuit comprising a first diode 21 and a first transistor 22 and a second series circuit comprising a second transistor 32 and a second diode 24. The first and second diodes are reverse biased with respect to the DC power source 20. A solenoid coil or an inductive element 25 for driving a plunger is coupled between the first and second series circuits and an input device 26 is coupled to the bases of the transistors 22 and 23 so as to simultaneously turn or turn off the same. When the transistors 22 and 23 are simultaneously turned off, a current induced due to the counter-electromotive force of the solenoid coil 25 flows through the first diode 21, rechargeable battery 20 and second diode 24, wherein a current is regenerated from the battery 20.

These two types of conventional driving circuits have the following shortcomings. The first driving circuit shown in FIG. 2 requires two rechargeable batteries 34 and 36 for supplying source voltages and clamping a voltage induced by a counter-electromotive force, as well as a relay circuit for changing over two switches 33 and 35.. This increases the manufacturing cost, the number of causes for possible damages and the weight of the driving circuit. Further, an undue counter-electromotive force induced by the opening of the switching element 32 causes to flow a current greater than the rated charge currents of the rechargeable batteries 34 and 36 through these batteries. This deteriorates the batteries 34 and 36, which may result in liquid leakage and reduction in their abilities.

With regard to the second driving circuit, an undue counter-electromotive force induced by the turning off of the transistors 22 and 23 causes to flow a current greater than the rated charge currents of the rechargeable battery 20 therethrough. This deteriorates the battery 20, and thus results in liquid leakage and reduction in the ability of the battery 20.

SUMMARY OF THE INVENTION

Accordingly, it is an object of this invention to provide a solenoid pump driving circuit which can regenerate the counter-electromotive force induced by an inductive element from a rechargeable battery with no load on the battery.

To achieve the above and other objects, there is provided a driving circuit comprising:

a DC power source for supplying a driving current, the DC power source having a positive terminal and a negative terminal;

an inductive element coupled to the power source, the inductive element having first and second terminals and producing a driving force when the driving current flows therein a first switching element coupled between the power source and the inductive element for interrupting the driving current from flowing in the inductive element, the inductive element generating a counter-electromotive force when the flow of the driving current in the inductive element is interrupted;

an accumulating circuit connected to the inductive element for accumulating the counter-electromotive force; and a releasing circuit connected to the accumulating circuit for releasing the counter-electromotive force accumulated in the accumulating circuit.

The counter-electromotive force released by the releasing circuit produces a superfluous driving current, and the superfluous driving current is superimposed on the driving current supplied from the power source and the superimposed current flows in the inductive element.

With the above arrangement, the counter-electromotive force induced in the inductive element at the time when the supply of the driving current to the inductive element is interrupted is temporarily accumulated in the accumulating circuit, and the counter-electromotive force is regenerated when the solenoid pump is subsequently driven by the inductive element. Specifically, the superfluous driving current is produced by the regenerated counter-electromotive force and is superimposed on the driving current supplied from the DC power source. This reduces power consumption as well as eliminates the influence of the counter-electromotive force on the power source, thus preventing deterioration of the power source and elongating its service life. In addition, a single power source makes the driving circuit compact in size and light in weight.

DETAILED DESCRIPTION OF THE PREFERRED EMBODIMENT

A preferred embodiment of the present invention will be described with reference to FIGS. 4 and 5.

Figure 4:
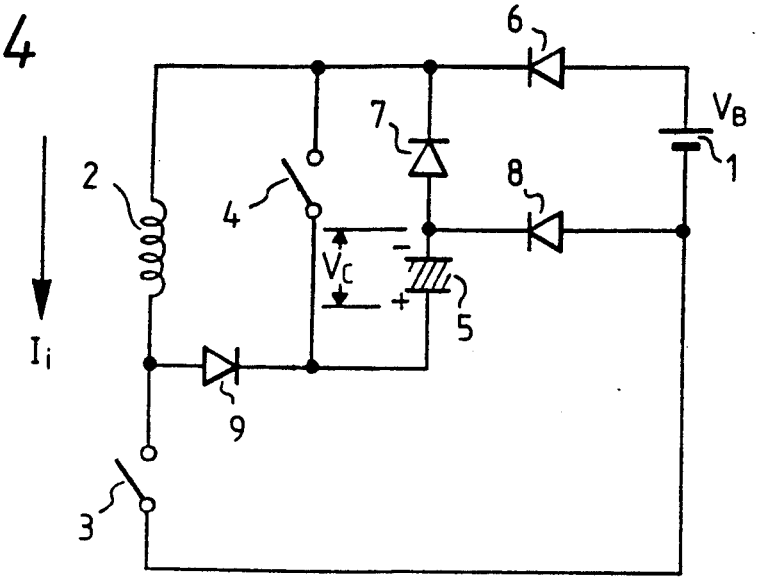
FIG. 4 is a circuit diagram illustrating a solenoid pump driving circuit according to the present invention.
Figure 5:
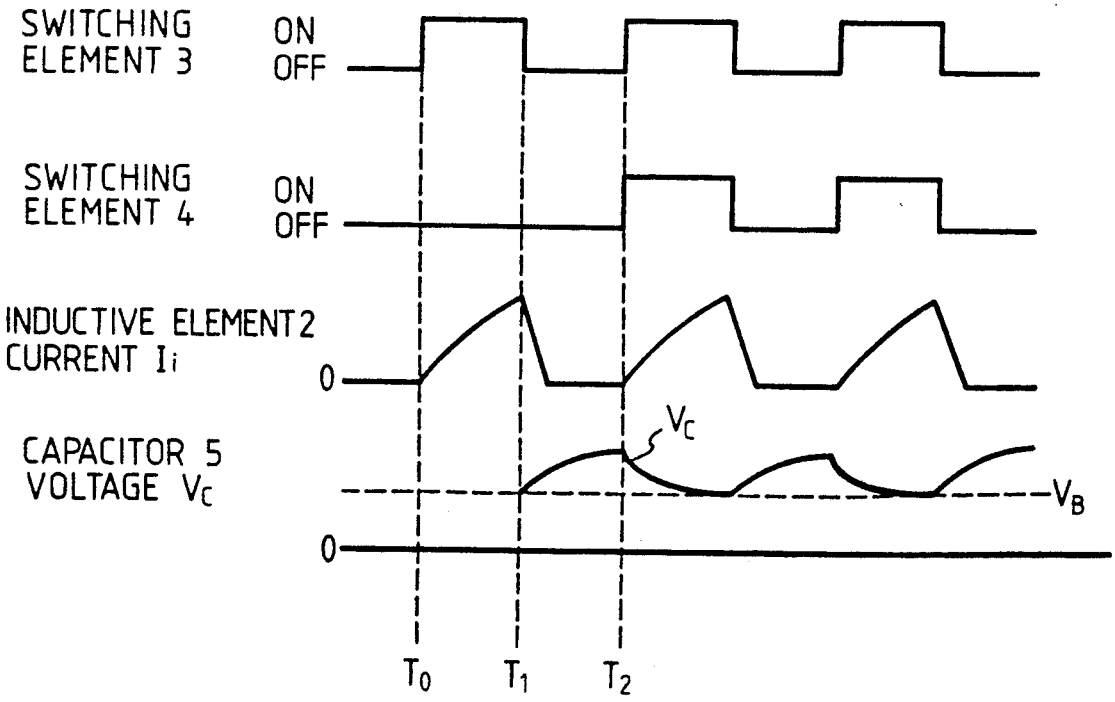
FIG. 5 is a waveform diagram for description of the operation of the driving circuit shown in FIG. 4.

FIG. 4 illustrates a driving circuit for a solenoid driven pump. In this circuit, an exciting coil or an inductive element 2 and a first switching element 3 are coupled in series to a DC rechargeable battery 1 through a reverse-current blocking diode 6. A series circuit comprising a second reverse-current blocking diode 7, a counter-electromotive force regenerating capacitor 5, and a third reverse-current blocking diode 9 is coupled between a node connecting the diode 6 and the exciting coil 2 and another node connecting the coil 2 and the first switching element 3. This series circuit is coupled in parallel to the exciting coil 2 with respect to the battery 1 and serves as a charging circuit in which the counter-electromotive force generated when the switching element 3 is opened is accumulated and charged in the capacitor 5. A second switching element 4 is coupled in parallel to the capacitor 5 and the diode 7. The switching elements 3 and 4 are simultaneously rendered open or closed. In other words, a discharging circuit is provided which comprises the capacitor 5, the second diode 7, and the switching element 4. A reverse-current blocking diode 8 is coupled between a node connecting the capacitor 5 and the diode 7 and the minus side of the battery 1, in which the anode of the diode 8 is connected to the minus side of the battery 1 and the cathode thereof to the latter node.

Figure 1:
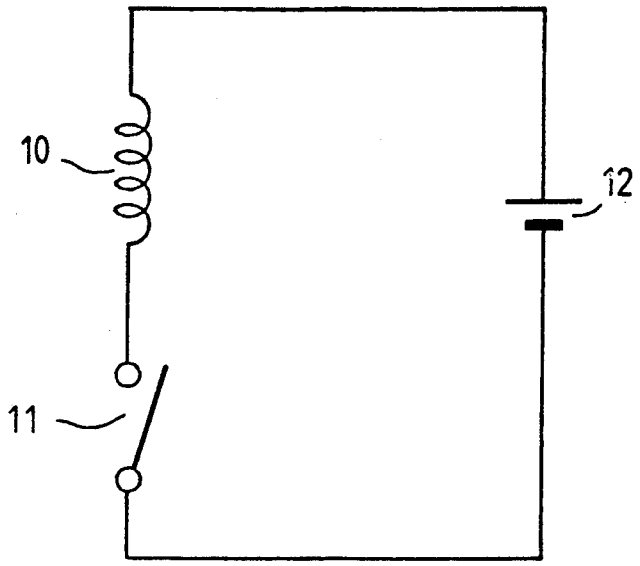
FIG. 1 PRIOR ART
FIG. 1 is a circuit diagram illustrating a principle of a conventional solenoid pump driving circuit.
Figure 2:
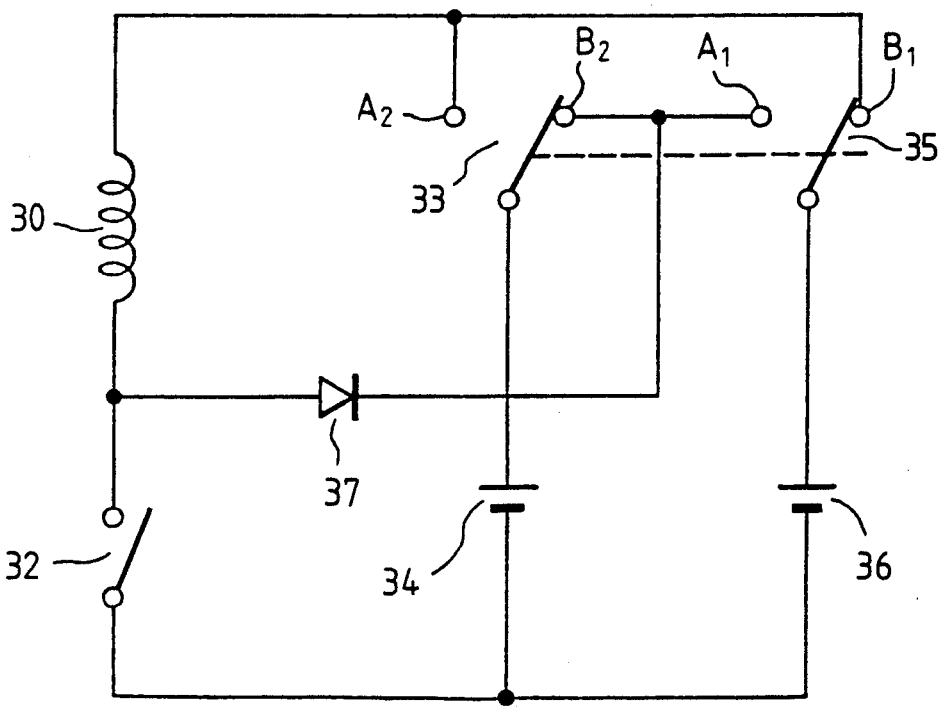
FIG. 2 PRIOR ART
FIG. 2 is a circuit diagram illustrating a conventional solenoid pump driving circuit.
Figure 3:
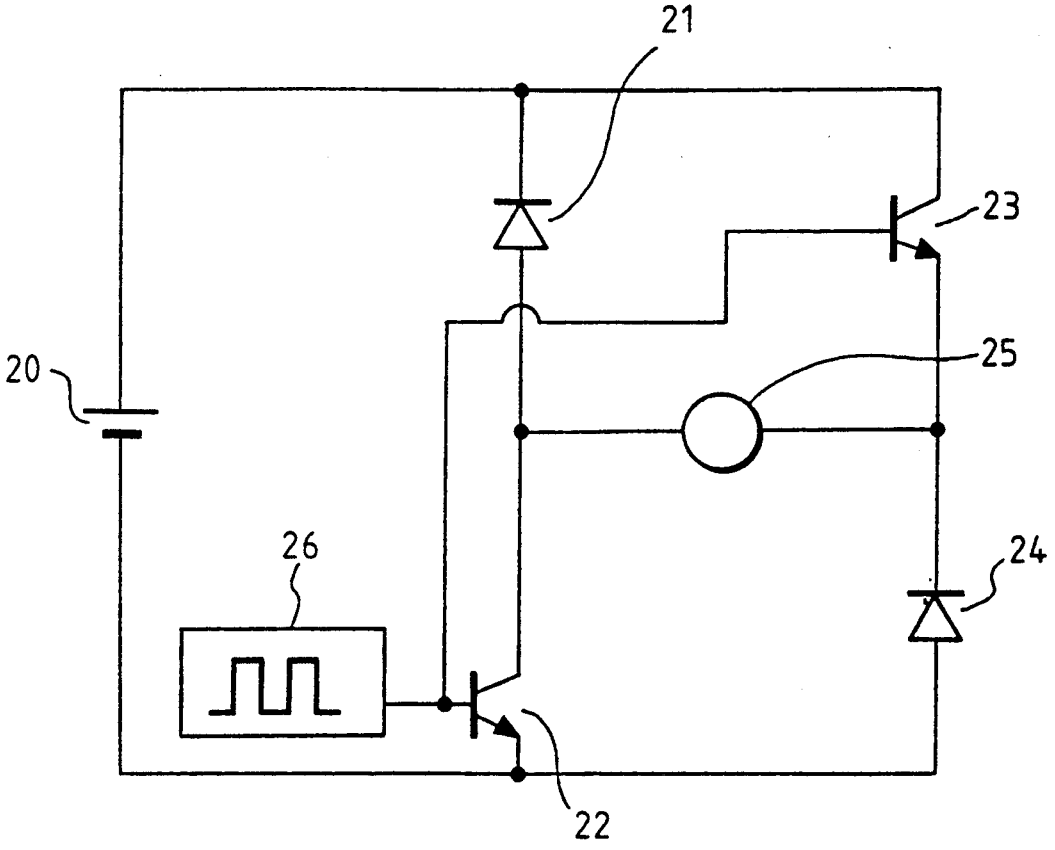
FIG. 3 PRIOR ART
FIG. 3 is circuit diagram illustrating another conventional solenoid pump driving circuit.

Referring to FIG. 3, the operation of the driving circuit configured as described above will be described below.

With the switching element 4 opened, when the switching element 3 is closed at time instant TO, a current flows through a loop defined by the rechargeable battery 1, diode 6 exciting coil 2 and switching element 3. Then, when the switching element 3 is opened at time instant T1, a discharging current caused by the magnetic energy held in the exciting coil 2 flows through a loop defined by the exciting coil 2, diode 9, capacitor 5 and diode 7, and is charged in the capacitor 5, thereby increasing the voltage Vc across the capacitor 5. This removes a burden caused by the counter-electromotive force from the rechargeable battery 1.

When the switching elements 3 and 4 are simultaneously closed at time instant T2, a superimposed current attained by adding a current from the rechargeable battery 1 to the discharge current from the capacitor 5 flows through the exciting coil 2, so that the voltage across the capacitor 5 falls to the voltage $V_B$ of the battery 1. In this manner, the counter-electromotive force induced by the exciting coil 2 is temporarily stored in the capacitor 5 and is used again by the exciting coil 2 when the next switching operation is performed.

The third reverse-current blocking diode 9 may be replaced by a switching element which is operated in the opposite phase to those of the first and second switching elements 3 and 4.

With the above-described arrangement of the invention, a driving circuit including an inductive element regenerates the counter-electromotive force induced for use in an inductive element without putting a burden on a rechargeable battery. Therefore, deterioration of the power source can be prevented, thus the service life of the power source is prolonged and power consumption is reduced.

What is claimed is:

1. An intermittent driving circuit for an inductive load, comprising:

a DC power source (1) for supplying a driving current, said DC power source having a positive terminal and a negative terminal;

an inductive element (2) coupled to said power source, said inductive element having first and second terminals and producing a driving force when the driving current flows therein;

a first switching element (3) coupled between said power source and said inductive element for interrupting and driving current from flowing in said inductive element, said inductive element generating a counter-electromotive force when the flow of the driving current in said inductive element is interrupted;

capacitive storage means (5) connected to said inductive element for accumulating the counter-electromotive force; and a releasing circuit comprising a second switching element (4) connected to said first switching element and connected to said capacitive storage means for discharging the counter-electromotive force accumulated in said capacitive storage means directly through said inductive element upon closure of said connected first and second switching elements.

2. A driving circuit according to claim 1, wherein said counter-electromotive force discharged by said releasing circuit produces a superfluous driving current, said superfluous driving current being superimposed on said driving current supplied from said power source and the superimposed current flowing in said inductive element.

3. A driving circuit according to claim 2, wherein said capacitive storage means further comprises a first diode (9) having an anode coupled to a capacitor of said capacitive storage means and a cathode coupled to said first terminal of said inductive element.

4. A driving circuit according to claim 3, wherein said capacitive storage means further comprises a second diode (7) having an anode connected to said second terminal of said inductive element and a cathode connected to said capacitor.

5. A driving circuit according to claim 4, further comprising a third diode (6) having an anode connected to said positive terminal of said power source and a cathode connected to said first terminal of said inductive element.

6. A driving circuit according to claim 5, further comprising a fourth diode (8) having an anode connected to said negative terminal of said power source and a cathode connected to said capacitor for preventing said superfluous driving current from flowing into said power source.

* * * * *